US005433585A

United States Patent [19]

Yan

[11] Patent Number: 5,433,585

[45] Date of Patent: Jul. 18, 1995

[54] DOUBLE-SEGMENTED SUPPORT FOR CEILING FAN BLADES

[76] Inventor: Fang-Chyuan Yan, 3-3, Alley 81, Lane 258, Su-Yuan Road, Fong Yuan City, Taichung Hsien, Taiwan

[21] Appl. No.: 207,326

[22] Filed: Mar. 7, 1994

[51] Int. Cl.[6] ..... F04D 29/34

[52] U.S. Cl. ..... 416/204 R; 416/5

[58] Field of Search ..... 416/5, 204 R, 210 R; D23/377, 379, 385, 411

[56] References Cited

U.S. PATENT DOCUMENTS

| | | | |
|---|---|---|---|
| 741,107 | 10/1903 | Burnes | 416/5 |
| 4,396,352 | 8/1983 | Pearce | 416/5 |
| 4,776,761 | 10/1988 | Diaz | 416/5 |
| 5,108,260 | 4/1992 | Monrose, III et al. | 416/204 R |
| 5,180,284 | 1/1993 | Monrose, III et al. | 416/204 R |
| 5,304,037 | 4/1994 | Scofield | 416/5 |

*Primary Examiner*—Edward K. Look
*Assistant Examiner*—Michael S. Lee
*Attorney, Agent, or Firm*—Alfred Lei

[57] ABSTRACT

A ceiling fan blade support comprises a fastening segment and blade support segment. The fastening segment is fastened to a main body of the ceiling fan and provided at one end thereof with a vertical surface having a pivoting cut. The blade support body is provided at one end thereof with a protruded piece engageable with the pivoting cut of the fastening segment. The protruded piece has a pivoting botom side provided with a slanted surface having an angle of inclination ranging between 10 and 15 degrees. In operation, the ceiling fan blades are so balanced as to eliminate the excessive vibration of the ceiling fan.

3 Claims, 4 Drawing Sheets

DOUBLE-SEGMENTED SUPPORT FOR CEILING FAN BLADES

BACKGROUND OF THE INVENTION

The present invention relates generally to a ceiling fan, and more particularly to a double-segmented support for the ceiling fan blades.

The conventional ceiling fan is generally made in quantity by molding and punching for lowering the production cost and even at the expense of the product precision. In addition, the conventional ceiling fan is suspended by means of one suspension rod such that the fan blades are mounted on a blade support 30 in a fixed manner, as shown in FIG. 1. As a result, when the fan blades of the conventional ceiling fan is in operation, the main body of the ceiling fan is caused to vibrate excessively. Such an excessive vibration of the ceiling fan can be further aggravated by an improper balance of the size and the weight of the fan blades. A ceiling fan which vibrates excessively in operation is no doubt a safety hazard.

SUMMARY OF THE INVENTION

The primary objective of the present invention is therefore provide a double-segmented support for ceiling fan blades, which can eliminate the vibration of the ceiling fan in operation.

The foregoing objective of the present invention is attained by the double-segmented support for ceiling fan blades, which comprises two segments, one of which is fastened to the main body of the ceiling fan while another one of which has a pivoting surface provded with an appropriate bevel for allowing the fan blades in operation to swing adjustably so as to balance the entire body of the ceiling fan in operation.

The foregoing objective, structures and features of the present invention will be more readily understood by studying the Following detailed description of the present invention conjunction with the drawings provided herewith.

DETAILED DESCRIPTION OF THE INVENTION

Figure 1:
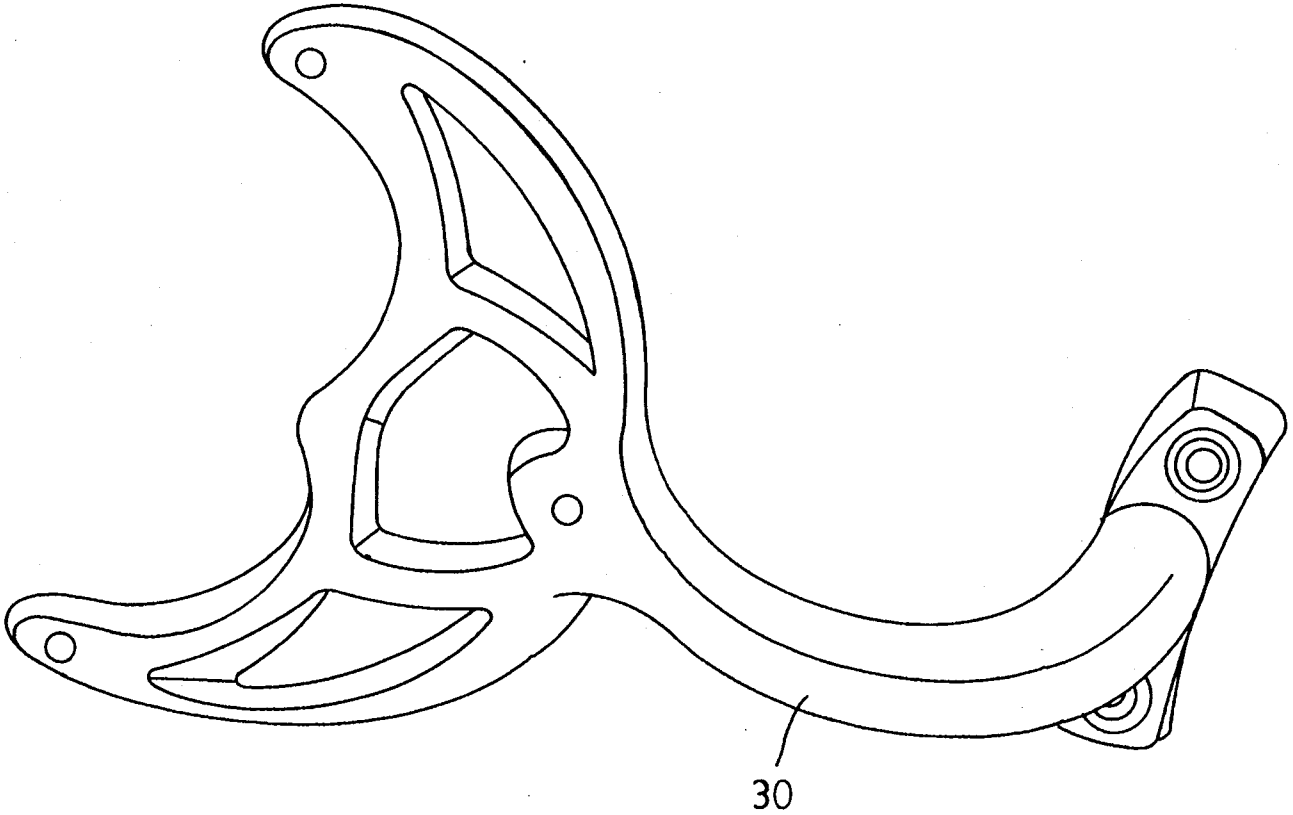
PRIOR ART FIG. 1
FIG. 1 shows a perspective schematic view of a ceiling fan blade support of the prior art.
Figure 2:
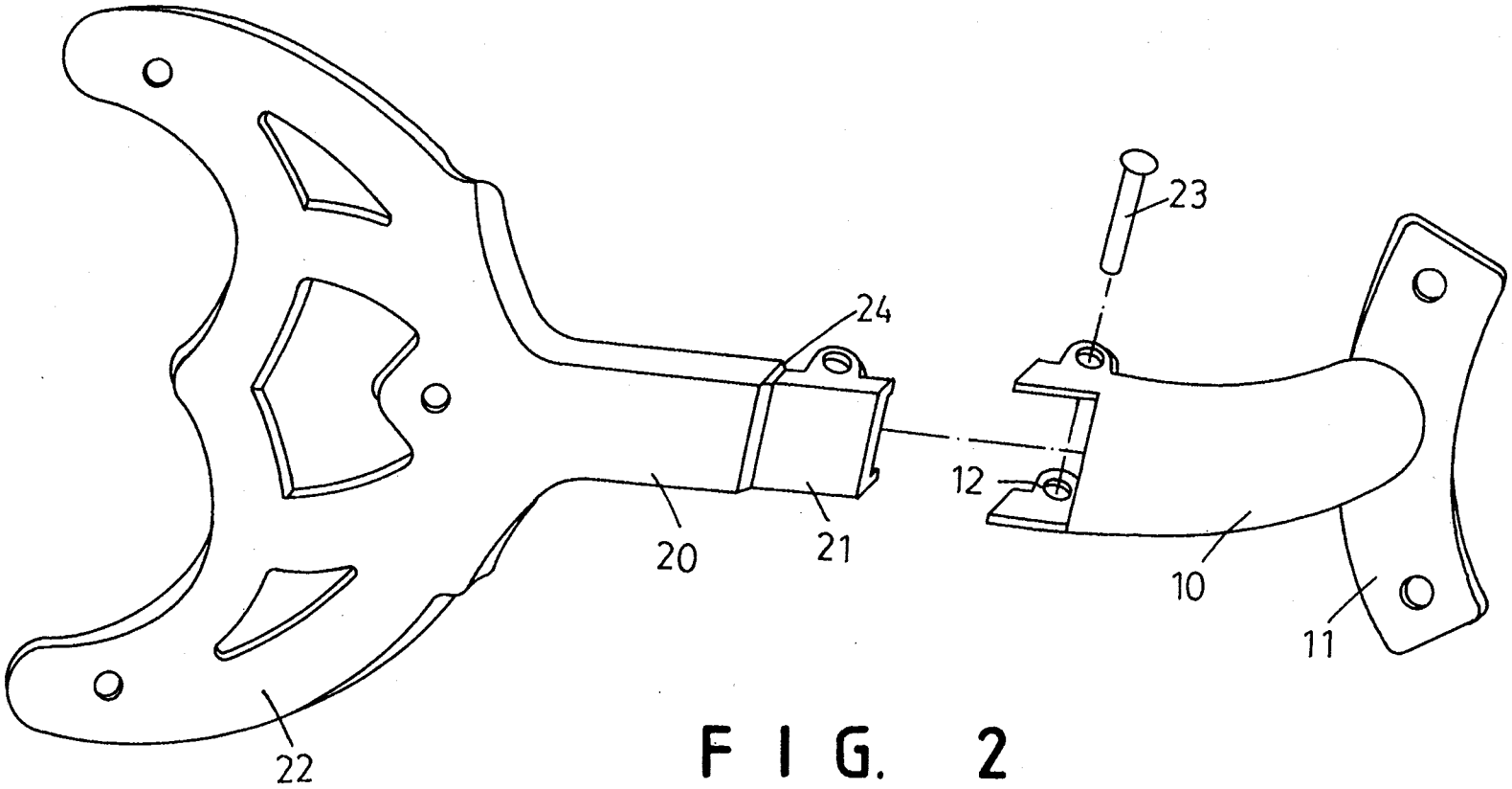
FIG. 2 shows an exploded view of a double-segmented support for ceiling fan blades, according to the present invention.
Figure 3:
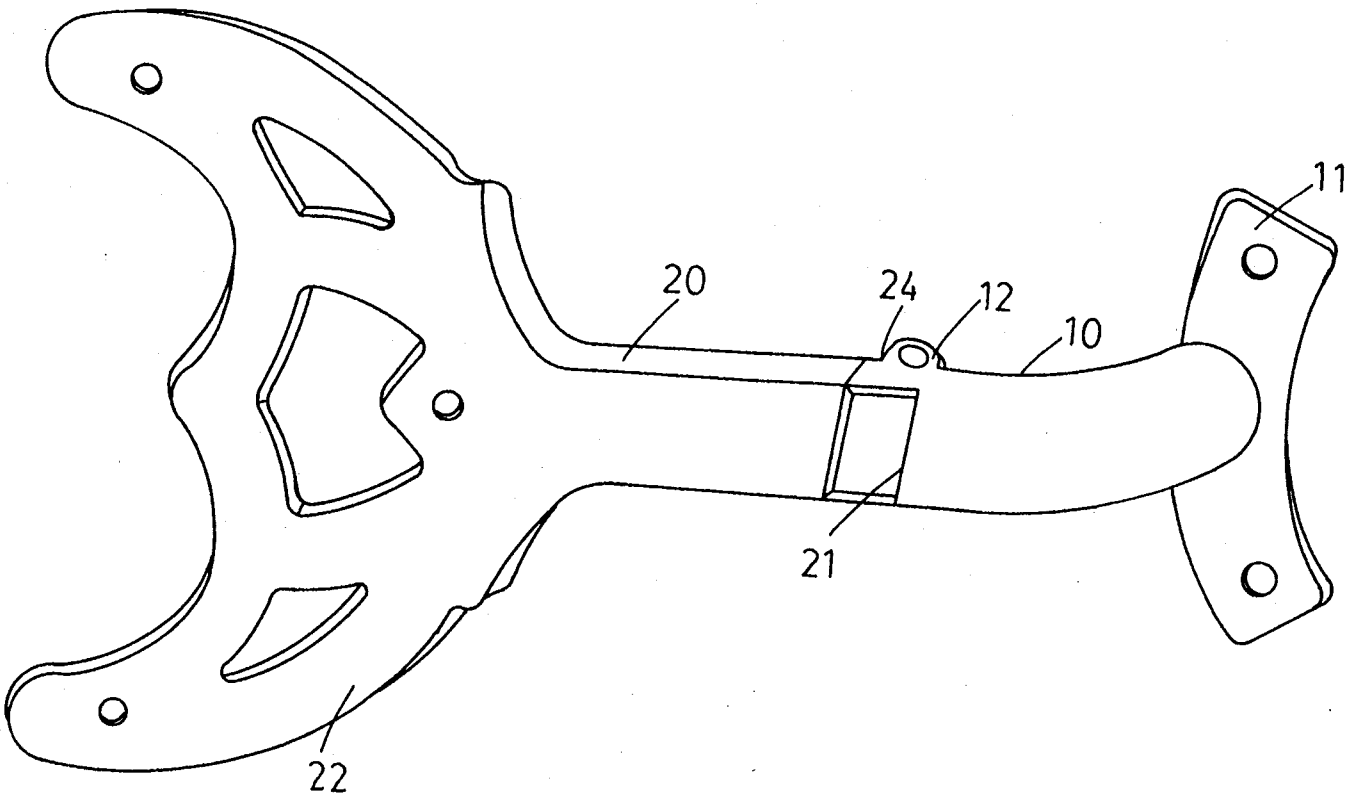
FIG. 3 shows a schematic view of the present invention in combination.

As shown in FIG. 2 and 3, the fan blade support of the present invention comprises two segments, one of which is a fastening segment 10 provided at one end thereof with a fastening piece 11 intended for use in fastening the fan blade support with the main body of a ceiling fan. The fastening segment 10 is provided at another end thereof with a u-shaped cut 12 for pivoting a blade support body 20. Located at one end of the blade support body 20 is a protruded piece 21 dimensioned to engage the u-shaped cut 12 of the fastening segment 10. Located at another end of the blade support body 20 is an arcuate support 22 for locating the fan blades.

The fastening segment 10 and the blade support body 20 are pivoted together by a shaft rod 23, as shown in FIG. 2.

Figure 4:
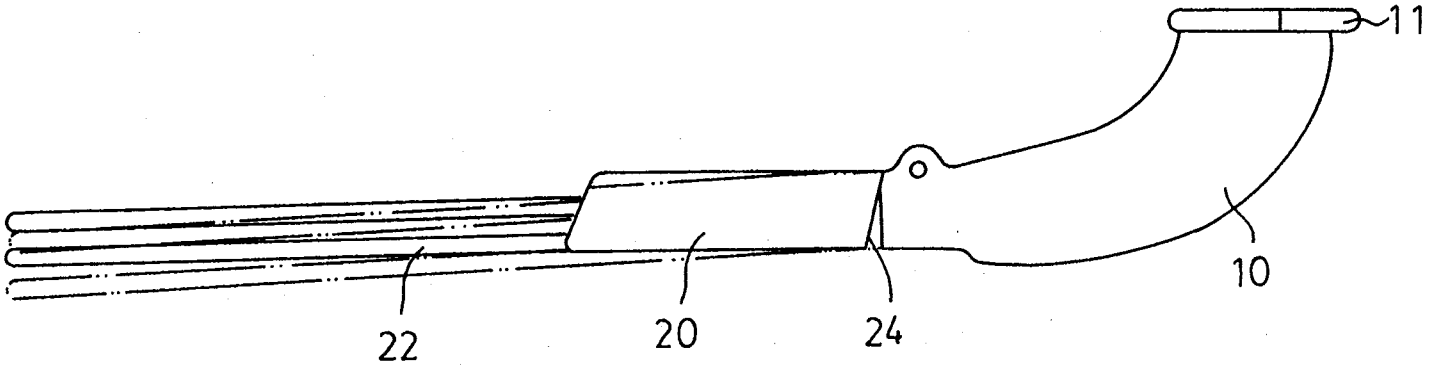
FIG. 4 shows a schematic view of the present invention in operation.

The present invention is characterized in that the blade support body 20 has an insertion bottom side 24 provided with a slanted surface ranging between 10 and 15 degrees, and that fastening segment 10 has a vertical pivoting surface, as shown in FIG. 4. As a result, the blade support body 20 is mounted at a predetermined bevel so that the fan blades, which are fastened to the blade support body 20, can adjust automatically their horizontal positions when the ceiling fan is in a high-speed operation. Therefore, the wind resistance is so reduced that the rotation of the fan blades does not cause the entire body of the ceiling fan to vibrate excessively.

The fastening segment 10 and the blade support body 20 of the present invention described above are made of iron by punching and may be electroplated. The size specification of the present invention can be easily controlled. In addition, the present invention is safer to use than the prior art blade support of zinc alloy, which is subject to oxidization when in operation.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claims.

What I claim is:

1. A double-segmented support for ceiling fan blades comprising a fastening segment and a blade support body wherein said fastening segment is fastened securely to a main body of a ceiling fan and provided at one end thereof with a vertical surface having a pivoting cut; and wherein said blade support body is provided at one end thereof with a protruded piece engageable with said pivoting cut of said fastening segment, said protruded piece having a pivoting bottom side provided with a slanted surface.

2. The double-segmented support for ceiling fan blades according to claim 1 wherein said slanted surface has an angle of inclination ranging between 10 and 15 degrees.

3. A double-segmented support for ceiling fan blades comprising a fastening segment and a blade support body wherein said fastening segment is fastened securely to a main body of a ceiling fan and provided at one end thereof with a slanted surface having a pivoting cut; and wherein said blade support is provided at one end thereof with a protruded piece engageable with said pivoting cut of said fastening segment, said protruded piece having a pivoting bottom side provided with a vertical surface.

* * * * *